US009297051B2

(12) United States Patent
Okamoto et al.

(10) Patent No.: US 9,297,051 B2
(45) Date of Patent: Mar. 29, 2016

(54) CASE HARDENING STEEL, METHOD FOR PRODUCING SAME, AND MECHANICAL STRUCTURAL PART USING CASE HARDENING STEEL

(75) Inventors: Nariaki Okamoto, Kobe (JP); Yosuke Shindo, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 386 days.

(21) Appl. No.: 14/008,352

(22) PCT Filed: Mar. 6, 2012

(86) PCT No.: PCT/JP2012/055661

§ 371 (c)(1),
(2), (4) Date: Sep. 27, 2013

(87) PCT Pub. No.: WO2012/132786

PCT Pub. Date: Oct. 4, 2012

(65) Prior Publication Data

US 2014/0014234 A1 Jan. 16, 2014

(30) Foreign Application Priority Data

Mar. 29, 2011 (JP) ..... 2011-071697

(51) Int. Cl.

| | |
|---|---|
| ***C22C 38/28*** | (2006.01) |
| ***C22C 38/32*** | (2006.01) |
| ***C21D 8/02*** | (2006.01) |
| ***C21D 1/06*** | (2006.01) |
| ***C23C 8/22*** | (2006.01) |
| ***C22C 38/00*** | (2006.01) |
| ***C22C 38/02*** | (2006.01) |

(Continued)

(52) U.S. Cl.

CPC .. *C21D 1/06* (2013.01); *C21D 7/13* (2013.01); *C22C 38/001* (2013.01); *C22C 38/02* (2013.01); *C22C 38/04* (2013.01); *C22C 38/06* (2013.01); *C22C 38/20* (2013.01); *C22C 38/28* (2013.01); *C22C 38/32* (2013.01); *C22C 38/42* (2013.01); *C22C 38/50* (2013.01); *C22C 38/54* (2013.01); *C23C 8/22* (2013.01); *C21D 2211/004* (2013.01)

(58) Field of Classification Search

None

See application file for complete search history.

(56) References Cited

U.S. PATENT DOCUMENTS

| | | | |
|---|---|---|---|
| 6,261,388 | B1 | 7/2001 | Kubota et al. |
| 2009/0087337 | A1 | 4/2009 | Saitoh et al. |

FOREIGN PATENT DOCUMENTS

| | | |
|---|---|---|
| JP | 10 277705 | 10/1998 |
| JP | 11 92868 | 4/1999 |

(Continued)

OTHER PUBLICATIONS

International Search Report Issued May 29, 2012 in PCT/JP12/055661 Filed Mar. 6, 2012.

(Continued)

*Primary Examiner* — Deborah Yee

(74) *Attorney, Agent, or Firm* — Oblon, McClelland, Maier & Neustadt, L.L.P

(57) ABSTRACT

A case hardening steel, which has excellent cold forgeability and excellent crystal grain coarsening prevention characteristics after carburization, contains, in mass %, 0.05-0.20% of C, 0.01-0.1% of Si, 0.3-0.6% of Mn, 0.03% or less of P (excluding 0%), 0.001-0.02% of S, 1.2-2.0% of Cr, 0.01-0.1% of Al, 0.010-0.10% of Ti, 0.010% or less of N (excluding 0%), and 0.0005-0.005% of B, with the balance consisting of iron and unavoidable impurities. The density of Ti-based precipitates having circle-equivalent diameters less than 20 nm in the case hardening steel is 10-100 pieces/$\mu m^2$; the density of Ti-based precipitates having diameters of 20 nm or more in the case hardening steel is 1.5-10 pieces/$\mu m^2$; and the case hardening steel has a Vickers hardness of 130 HV or less.

5 Claims, 1 Drawing Sheet

(51) Int. Cl.

| | |
|---|---|
| ***C22C 38/04*** | (2006.01) |
| ***C22C 38/06*** | (2006.01) |
| ***C22C 38/20*** | (2006.01) |
| ***C22C 38/42*** | (2006.01) |
| ***C22C 38/50*** | (2006.01) |
| ***C22C 38/54*** | (2006.01) |
| ***C21D 7/13*** | (2006.01) |

(56) References Cited

FOREIGN PATENT DOCUMENTS

| | | |
|---|---|---|
| JP | 2002-69573 | 3/2002 |
| JP | 2003 183773 | 7/2003 |
| JP | 2004 183064 | 7/2004 |
| JP | 2005 200667 | 7/2005 |
| JP | 2007 321211 | 12/2007 |
| JP | 2008 81841 | 4/2008 |
| JP | 2008-81841 A | 4/2008 |
| JP | 2010 229508 | 10/2010 |
| JP | 2010-229508 A | 10/2010 |
| JP | 2011 17051 | 1/2011 |
| JP | 2011-17051 A | 1/2011 |

OTHER PUBLICATIONS

The Extended European Search Report issued Nov. 25, 2014, in Application No. / Patent No. 12765188.3—1362 / 2692888.

Office Action issued Sep. 24, 2013 in Japanese Patent Application No. 2011-071697 with English language translation.

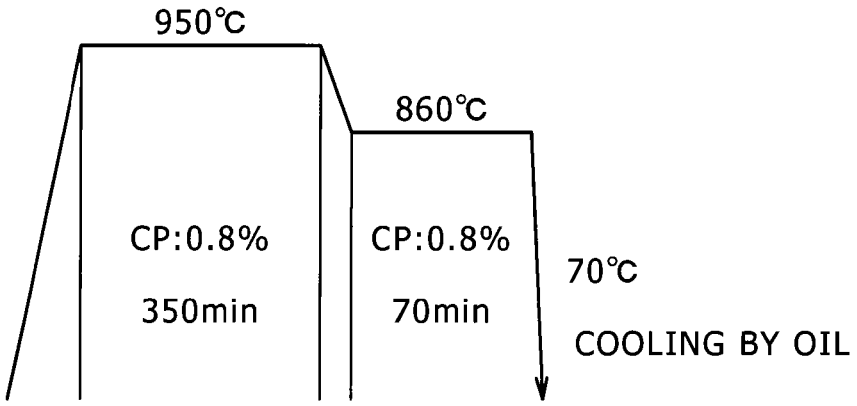
950℃
860℃
CP:0.8%
350min
CP:0.8%
70min
70℃
COOLING BY OIL

CASE HARDENING STEEL, METHOD FOR PRODUCING SAME, AND MECHANICAL STRUCTURAL PART USING CASE HARDENING STEEL

TECHNICAL FIELD

The present invention relates to a case hardening steel that becomes raw material of a mechanical structural part used after carburization in transportation equipment such as an automobile and the like, construction equipment, other industrial machines and the like, a method for producing the same, and a mechanical structural part obtained using the case hardening steel, and relates more specifically to a case hardening steel that exhibits cold forgeability and crystal grain coarsening prevention characteristics after carburization, a method for producing the same, and a mechanical structural part.

BACKGROUND ART

In a mechanical structural part used for various industrial machines such as the transportation equipment, construction equipment, other industrial machines and the like particularly for the raw material of the mechanical structural part requiring high strength, a low-alloyed steel for machine structural use (case hardening steel) stipulated in the JIS standards such as SCr, SCM, SNCM and the like has been conventionally used. The case hardening steel is formed into a desired part shape by mechanical work such as forging, machining and the like, is thereafter subjected to surface hardening treatment (case hardening treatment) such as carburizing, carbonitriding and the like and thereafter goes through the steps such as polishing and the like, and the mechanical structural part is manufactured.

In recent years, in the manufacturing step of the mechanical structural part, change from conventional hot forging and warm forging to cold forging has been desired. Cold forging is working executed in the atmosphere of 200° C. or below normally, and cold forging has such advantages that the productivity is excellent and both of the dimensional accuracy and the yield of the steel are excellent compared to those in hot forging and warm forging. However, when the case hardening steel stipulated in the JIS standards described above is used, such problems occur as insufficient cold forgeability, deterioration of the mechanical properties such as the part strength because of coarsening of the crystal grain by carburizing after cold forging. Therefore, as a technology for preventing coarsening of the crystal grain, technologies of Patent Literatures 1-3 have been disclosed. In these literatures, technologies of adding elements such as Ti, Nb, and the like, finely dispersing precipitates such as TiC, Nb(CN) and the like into steel thereby exerting a pinning effect, and preventing coarsening of the crystal grain have been disclosed. Also, in Patent Literature 4 for example, a technology for improving the cold forgeability by adjusting the adding amount of alloy elements while taking such crystal grain coarsening preventing measures has been proposed.

CITATION LIST

Patent Literatures

[Patent Literature 1] Japanese Unexamined Patent Application Publication No. H11-92868

[Patent Literature 2] Japanese Unexamined Patent Application Publication No. 2005-200667

[Patent Literature 3] Japanese Unexamined Patent Application Publication No. 2007-321211

[Patent Literature 4] Japanese Unexamined Patent Application Publication No. 2003-183773

SUMMARY OF INVENTION

Technical Problems

In the field of the mechanical structural part, the needs of employing cold forging are increasing more and more, and, also for the case hardening steel that becomes the raw material therefor, provision of a case hardening steel excellent in both of the cold forgeability and the crystal grain coarsening prevention characteristics after carburization has been desired more than before.

The present invention has been developed in view of such circumstances as described above, and its object is to provide a novel case hardening steel excellent in the crystal grain coarsening prevention characteristics after carburization while securing sufficient cold forgeability even in a part having a complicated shape and a large part, a method for producing the same, and a mechanical structural part obtained using the case hardening steel.

Solution to Problems

The case hardening steel in relation with the present invention that could solve the problems is a case hardening steel containing, in mass %, C: 0.05-0.20%, Si: 0.01-0.1%, Mn: 0.3-0.6%, P: 0.03% or less (excluding 0%), S: 0.001-0.02%, Cr: 1.2-2.0%, Al: 0.01-0.1%, Ti: 0.010-0.10%, N: 0.010% or less (excluding 0%), and B: 0.0005-0.005%, with the balance consisting of iron and unavoidable impurities, in which the density of Ti-based precipitates having the circle-equivalent diameter of less than 20 nm is 10-100 pieces/$\mu m^2$, the density of Ti-based precipitates having the circle-equivalent diameter of 20 nm or more is 1.5-10 pieces/$\mu m^2$, and Vickers hardness is 130 HV or less.

In a preferred embodiment of the present invention, the case hardening steel further contains Mo: 2% or less (excluding 0%).

In a preferred embodiment of the present invention, the case hardening steel further contains Cu: 0.1% or less (excluding 0%) and/or Ni: 3% or less (excluding 0%).

Also, a method for producing a case hardening steel in relation with the present invention that could solve the problems includes the steps of preparing steel of the chemical composition described in any of the above, soaking treatment for 30 min or less at 1,100° C.-1,280° C., and hot reworking for 120 min or less at 800-1,000° C.

Further, in the present invention, a mechanical structural part obtained by cold-working the case hardening steel described above and thereafter carburizing the same with the following stipulation is also included within the scope of the present invention: (A) the average grain size index of prior austenitic grain in a region from the surface to the position of 200 μm depth is No. 8-14, (B) the average grain size index of prior austenitic grain is No. 6-12 in a region from the position of 200 μm depth to the position of 500 μm depth from the surface and a coarse grain of prior austenitic grain with the grain size index of No. 5.5 or below is not contained.

Advantageous Effects of Invention

According to the case hardening steel of the present invention, because the fine Ti-based precipitates having the circle-equivalent diameter of less than 20 nm and the coarse Ti-based precipitates having the circle-equivalent diameter of 20 nm or more were dispersed with good balance by a proper density, the hardness was high and the deformation resistance in cold forging was suppressed, the cold forgeability was thereby enhanced, and coarsening of the grain by carburizing thereafter could be prevented.

BRIEF DESCRIPTION OF DRAWING

FIG. 1 is a schematic drawing showing a carburizing condition of example 1.

DESCRIPTION OF EMBODIMENTS

Although provision of a case hardening steel excellent in the crystal grain coarsening prevention characteristics after carburization and also excellent in the cold forgeability has been strongly desired as described above, in general, it was considered to be hard to achieve both of them simultaneously. The reason is as follows: as disclosed in the Patent Literatures 1-3 described above, in order to prevent coarsening of the crystal grain in carburizing after cold forging, it is effective to form fine precipitates such as TiC and the like, however, when the precipitates useful in prevention of coarsening of the crystal grain are formed more than the necessity, which adversely causes deterioration of the cold forgeability such as increase of the hardness and the deformation resistance in cold forging, difficulty of plastic deformation of steel, deterioration of the life of the mold and the like.

Therefore, the present inventors have repeatedly studied in order to provide a case hardening steel excellent in both the crystal grain coarsening prevention characteristics and the cold forgeability. As a result, it was found out that, when a case hardening steel was used in which Ti-based precipitates in steel were dispersed with proper balance depending on the size (circle-equivalent diameter) thereof, the desired object could be achieved, and the present invention was completed.

Although the Ti-based precipitates focused on in the present invention are precipitates effective in preventing coarsening of the crystal grain as described above, they are rather harmful from the viewpoint of the cold forgeability, also become a cause of increasing the hardness and the deformation resistance of steel because of precipitation strengthening of the Ti-based precipitates, and therefore cause deterioration of the cold forgeability. In order to prevent deterioration of the cold forgeability, to lower, as much as possible, the density of the coarse Ti-based precipitates having the circle-equivalent diameter of 20 nm or more largely affecting the deformation resistance, to thereby reduce the effect of precipitation strengthening by the coarse Ti-based precipitates, and to improve the cold forgeability can be conceived for example. However, according to the experiments by the present inventors, it was known that, when the density of the coarse Ti-based precipitates was excessively reduced, the crystal grain coarsening prevention effect could be exerted in the surface layer section of a carburizing material after carburization, however coarsening of the crystal grains occurred inside, and, as a result, the crystal grain coarsening prevention characteristics of the carburizing material was not exerted sufficiently.

Therefore, experiments were further repeated, and, as a result, it was found out that, when the density of the coarse Ti-based precipitates and the density of the fine Ti-based precipitates were controlled with good balance by preventing coarsening of the crystal grains not only of the surface layer section of the carburizing material but also of the inside by controlling the density of the coarse Ti-based precipitates having the circle-equivalent diameter of 20 nm or more into a predetermined range (1.5-10 pieces/$\mu m^2$) and controlling the density of the fine Ti-based precipitates having the circle-equivalent diameter of less than 20 nm into a predetermined range (10-100 pieces/$\mu m^2$) in order to suppress increase of the deformation resistance in cold forging due to presence of the coarse Ti-based precipitates (particularly by reducing the upper limit of the density of the fine Ti-based precipitates to 100 pieces/$\mu m^2$ or less), a case hardening steel having the hardness suitable to the cold forgeability, capable of further reducing the deformation resistance in cold forging than before, capable of effectively suppressing coarsening of the crystal grains not only of the surface layer section of the carburized material but also of the inside, and highly excellent in the crystal grain coarsening prevention characteristics of the carburized material as a whole could be obtained, and the present invention was completed.

In the present specification, "case hardening steel" means one obtained by using cast steel of the chemical composition containing alloy elements of Cr, Mn and the like such as SCr, SCM and the like, hot forging after soaking treatment (solution heat treatment), and hot reworking (hot rolling for example). Also, in the present specification, a mechanical structural part means one obtained by forming the case hardening steel produced as described above into a desired part shape by cold forging, machining and the like, and thereafter subjecting to surface hardening treatment (case hardening treatment) such as carburizing, carbonitriding and the like.

Also, in the present specification, "excellent in cold forgeability" means that, when the Vickers hardness and the average deformation resistance to 55% of the case hardening steel are measured by a condition described in the example described below, the Vickers hardness is 130 HV or less and the average deformation resistance to 55% is 600 MPa or less. These values are preferably as small as possible, and preferable Vickers hardness is 125 HV or less and preferable average deformation resistance is 590 MPa or less.

Further, in the present specification, "excellent in crystal grain coarsening prevention characteristics after carburization" means that, with respect to the carburizing material after carburization, when both of (A) the average grain size index of the grains present in the outermost layer region from the surface to the position of 200 μm depth and (B) the average grain size index of the grains present in the inner region from the position of 200 μm depth to the position of 500 μm depth from the surface are measured respectively by a method described in the example described below, both of (A) the average grain size index of the grains present in the outermost layer region is No. 8-14 and (B) the average grain size index of the grains present in the inner region is No. 6-12 and that a coarse grain of prior austenitic grain with the grain size index of No. 5.5 or below is not contained are satisfied. These average grain size indices are preferably as large as possible (that is, the average grain size is preferably as small as possible), and it is preferable that both of (A) the average grain size index of the grains present in the outermost layer region is No. 9-13 and (B) the average grain size index of the grains present in the inner region is No. 7-11 and that a coarse grain of prior austenitic grain with the grain size of No. 5.5 or below is not contained are satisfied.

First, the Ti-based precipitates that most significantly characterize the present invention will be described.

In the present invention, Ti-based precipitates mean precipitates at least containing Ti. More specifically, in addition to precipitates containing only Ti such as TiC (carbide of Ti), TiN (nitride of Ti), Ti(CN) (carbonitride of Ti) for example, composite precipitates that are the precipitates described above further containing carbide-, nitride- and carbonitride-forming elements such as B, Al and the like for example are also included in the Ti-based precipitates.

Also, the case hardening steel of the present invention is characterized in that the density of the Ti-based precipitates having the circle-equivalent diameter of less than 20 nm is 10-100 pieces/$\mu m^2$ and the density of the Ti-based precipitates having the circle-equivalent diameter of 20 nm or more is 1.5-10 pieces/$\mu m^2$. In the present specification, for convenience of explanation, there is a case the Ti-based precipitates having the circle-equivalent diameter of less than 20 nm are called fine Ti-based precipitates and the Ti-based precipitates having the circle-equivalent diameter of 20 nm or more are called coarse Ti-based precipitates.

Here, the concept of density control of the Ti-based precipitates in the present invention will be described one more time. As is mentioned repeatedly, in the case hardening steel, the Ti-based precipitates are known to generally have a crystal grain coarsening prevention action in carburizing, and such the crystal grain coarsening prevention characteristics are said to be improved as the particle diameter of the Ti-based precipitates is smaller and the density is higher. However, because precipitation strengthening occurs and the cold forgeability deteriorates due to formation of the Ti-based precipitates, in order to exert excellent cold forgeability, the particle diameter of the Ti-based precipitates should be made small as much as possible and the density should be lowered. Therefore, in order to achieve both of the excellent cold forgeability and crystal grain coarsening prevention characteristics simultaneously, the particle diameter and the density of the Ti-based precipitates should be well adjusted. According to the result of the experiments by the present inventors, it was revealed that the case hardening steel in which the density of the fine Ti-based precipitates having the circle-equivalent diameter of less than 20 nm and the density of the coarse Ti-based precipitates having the circle-equivalent diameter of 20 nm or more were controlled respectively with good balance with the Ti-based precipitates having the circle-equivalent diameter of 20 nm as a border was superior to that of a prior art in both of the crystal grain coarsening prevention characteristics after carburization and the cold forgeability.

This point will be described in a little bit more detail. According to the result of the experiments by the present inventors, it was revealed that not all of the Ti-based precipitates effectively exerted the crystal grain coarsening prevention characteristics in carburizing after cold forging, but the crystal grain coarsening prevention characteristics are largely affected by their particle diameter and the C content of a matrix. In other words, when the particle diameter (circle-equivalent diameter) of the Ti-based precipitates is small or the C content of the matrix is low, the Ti-based precipitates in carburizing become unstable and the crystal grain coarsening prevention characteristics cannot be exerted effectively. Also, because the C content largely varies between the surface layer section and the inside of the steel by carburization and coarsening of the crystal grain is liable to occur in the inside of the steel where the C content is low compared to the surface layer section of the steel where the C content is high even in the same steel (carburized material), in order to prevent it, the density of the Ti-based precipitates with a large particle diameter should be increased. However, when the density of the Ti-based precipitates with a large particle diameter is increased, the cold forgeability deteriorates adversely, and therefore, in the present invention, the upper limit of the density of the fine Ti-based precipitates having the circle-equivalent diameter of less than 20 nm was limited with the aim of compensating deterioration of the cold forgeability accompanied by formation of coarse Ti-based precipitates.

On the other hand, although the fine Ti-based precipitates particularly exert the crystal grain coarsening prevention characteristics effectively in the surface layer of the steel where the C content is high, in order to further increase the strength of the steel after carburization, the crystal grain size of the surface layer should be further miniaturized (that is, the density of the fine Ti-based precipitates should be increased). Therefore, in the present invention, in order to form a lot of fine Ti-based precipitates with less adverse effects on the cold forgeability than the coarse Ti-based precipitates and to effectively exert the crystal grain miniaturizing effect in the surface layer where the C content was high, the lower limit of the density of the fine Ti-based precipitates was limited.

Below, respective Ti-based precipitates will be described.

First, the density of the fine Ti-based precipitates having the circle-equivalent diameter of less than 20 nm is 10-100 pieces/$\mu m^2$. The fine Ti-based precipitates have an action of effectively exerting the crystal grain coarsening prevention characteristics after carburization, and, in order to effectively exert such action, the lower limit of the density of the fine Ti-based precipitates was made 10 pieces/$\mu m^2$ or more. On the other hand, when the density of the fine Ti-based precipitates is excessively high, the cold forgeability is deteriorated by precipitation strengthening by the Ti-based precipitates, and therefore the upper limit thereof was made 100 pieces/$\mu m^2$ or less. When the balance between the crystal grain coarsening prevention characteristics after carburization and the cold forgeability is taken into consideration, preferable density of the fine Ti-based precipitates is 20-90 pieces/$\mu m^2$, and more preferable density is 25-85 pieces/$\mu m^2$.

Next, the density of the Ti-based precipitates having the circle-equivalent diameter of 20 nm or more is 1.5-10 pieces/$\mu m^2$. The coarse Ti-based precipitates having the circle-equivalent diameter of 20 nm or more are useful in improving the crystal grain coarsening prevention characteristics in the inside of steel (carburized material) where the C content is low in particular, and, in order to effectively exert such action, the lower limit of the density of the coarse Ti-based precipitates was made 1.5 pieces/$\mu m^2$ or more. On the other hand, the coarse Ti-based precipitates exert significant adverse effects on the cold forgeability, and, when the density of the coarse Ti-based precipitates is excessively high, the cold forgeability is deteriorated by precipitation strengthening by the Ti-based precipitates, and therefore the upper limit thereof was made 10 pieces/$\mu m^2$ or less. When the balance between the crystal grain coarsening prevention characteristics after carburization and the cold forgeability is taken into consideration, the preferable density of the coarse Ti-based precipitates is 2.0-9.0 pieces/$\mu m^2$, and more preferable density is 2.5-8.5 pieces/$\mu m^2$.

Although the density of the fine Ti-based precipitates and the coarse Ti-based precipitates in the case hardening steel in relation with the present invention is as described above, the density of all Ti-based precipitates present in the case hardening steel generally is preferably 11.5-110 pieces/$\mu m^2$, more preferably 20-100 pieces/$\mu m^2$.

The Ti-based precipitates most significantly characterizing the present invention was described above.

Although the case hardening steel of the present invention is characterized by containing the coarse Ti-based precipitates and the fine Nb-based precipitates by a predetermined density with good balance as described above, the componential composition of the steel should also be properly adjusted. Although the composition in steel of the present invention is to be controlled into the range of the case hardening steel stipulated in the JIS standards, in the present invention, to reduce the deformation resistance in cold forging than before is stated as one of the problems to be solved, and the C content is controlled to the lower side from such a viewpoint. Also, in order to prevent deterioration of the quenchability accompanied by reduction of the C content, quenchability enhancing elements such as B and the like are contained as the indispensable composition, and quenchability improving elements such as Mo and the like are also contained as the selective composition according to the necessity.

Below, the componential composition of the case hardening steel in relation with the present invention will be described.

[C: 0.05-0.20%]

C is an element required for securing the hardness of a core section required as a part, and, when the C amount is less than 0.05%, the static strength as a part is insufficient due to insufficient hardness. Further, there is also a problem that the density of the coarse Ti-based precipitates useful for preventing coarsening of the crystal grain inside the carburizing material significantly reduces. However, when C is contained excessively, the hardness increases excessively, the balance of the density of the fine Ti-based precipitates and the coarse Ti-based precipitates deteriorates to deteriorate the cold forgeability, and therefore the upper limit thereof is made 0.20% or less. Preferable C content is 0.07% or more and 0.18% or less, more preferably 0.08% or more and 0.17% or less.

[Si: 0.01-0.1%]

Si is an element effective in suppressing drop of the hardness in tempering treatment after carburization and securing the hardness of the surface layer of the carburized part (mechanical structural part). In order to effectively exert such effect, the lower limit of the Si amount is made 0.01% or more. The action improves as the Si amount increases, and the lower limit is preferably 0.02% or more, more preferably 0.03% or more. However, when Si is contained excessively, the density of the coarse Ti-based precipitates significantly drops to adversely affect the cold forgeability, and therefore the upper limit of the Si amount is made 0.1%. Preferable upper limit of the Si amount is 0.08% or less, and more preferably 0.06% or less.

[Mn: 0.3-0.6%]

Mn is an element remarkably enhancing the quenchability in carburizing treatment. Also, Mn is an element acting as a deoxidizing agent, and having actions of reducing the amount of oxide-based inclusions present in steel and improving the internal quality of the steel. Further, when the Mn amount is not sufficient, red heat shortness occurs and the productivity drops. In order to effectively exert such actions, the lower limit of the Mn amount is made 0.3% or more. Preferable lower limit of the Mn amount is 0.33% or more, and more preferably 0.35% or more. However, when Mn is contained excessively, such problems occur that the cold forgeability is affected adversely, a stripe-like segregation becomes conspicuous, dispersion of the material increases and the like. Further, by adding Mn excessively, the forgeability is deteriorated, a stripe-like segregation is formed, and dispersion of the material increases. Therefore, the upper limit of the Mn amount is made 0.6%. Preferable upper limit of the Mn amount is 0.55% or less, and more preferably 0.5% or less.

[P: 0.03% or Less (Excluding 0%)]

P is an element contained in steel as unavoidable impurities, segregates in the crystal grain boundary to deteriorate the impact fatigue resistance of a mechanical structural part, and therefore the upper limit of the P amount is made 0.03% or less. The P amount is preferably reduced as much as possible and is preferably 0.025% or less, and more preferably 0.020% or less.

[S: 0.001-0.02%]

S is an element forming MnS by bonding to Mn and improving the machinability in machining after cold working. In order to effectively exert such action, the lower limit of the S amount is made 0.001% or more. Preferable lower limit of the S amount is 0.002% or more, and more preferably 0.005% or more. However, when S is contained excessively, the impact fatigue strength may drop, and therefore the upper limit of the S amount is made 0.02%. Preferable upper limit of the S amount is 0.015% or less, and more preferably 0.010% or less.

[Cr: 1.2-2.0%]

Since Cr is an element useful in promoting carburization, forming a hardened layer on the surface of steel, and securing the part strength after carburization, the lower limit of the Cr amount is made 1.2%. Preferable lower limit of the Cr amount is 1.30% or more, and more preferably 1.35% or more. However, when Cr is contained excessively, excessive carburization occurs, Cr carbide is formed, the part strength after carburization increases to deteriorate the cold forgeability, and therefore the upper limit of the Cr amount is made 2.0%. Preferable upper limit of the Cr amount is 1.90% or less, and more preferably 1.80% or less.

[Al: 0.01-0.1%]

Al is an element acting as a deoxidizing agent, and, in order to exert such action effectively, the lower limit of the Al amount is made 0.01%. Preferable lower limit of the Al amount is 0.02%, and more preferably 0.03% or more. However, when Al is contained excessively, the deformation resistance and the hardness of steel increase to deteriorate the cold forgeability, and therefore the upper limit of the Al amount is made 0.1%. Preferable upper limit of the Al amount is 0.08% or less, and more preferably 0.07% or less.

[Ti: 0.010-0.10%]

Ti is an element required for bonding to C and N present in steel and forming the Ti-based precipitates exerting a pinning effect that is useful in preventing coarsening of the crystal grain in carburizing. In order to exert such action effectively, the lower limit of the Ti amount is made 0.010%. Preferable lower limit of the Ti amount is 0.02%, and more preferably 0.030% or more. However, when Ti is contained excessively, the density of the fine Ti-based precipitates increases to deteriorate the cold forgeability, and therefore the upper limit of the Ti amount is made 0.10%. Preferable upper limit of the Ti amount is 0.06% or less, and more preferably 0.050% or less.

[N: 0.010% or Less (Excluding 0%)]

Although N is an element inevitably contained in the steel making step, N is solid-dissolved in the matrix and the cold forgeability deteriorates along with increase of the N amount. Also, when the N amount increases, the density of the fine Ti-based precipitates drop, desired crystal grain coarsening prevention characteristics cannot be secured, and therefore the upper limit of the N amount is made 0.010% or less. Preferable upper limit of the N amount is 0.008% or less, and more preferably 0.05% or less.

[B: 0.0005-0.005%]

B is an element substantially improving the quenchability of steel with a minute amount. Further, B also has actions of strengthening the crystal grain boundary and enhancing the impact fatigue strength. In order to exert such actions effectively, the lower limit of the B amount is made 0.0005%. Preferable lower limit of the B amount is 0.0007% or more, and more preferably 0.0009% or more. However, even when B is contained excessively, the actions saturate, B nitride is liable to be formed, the cold workability and hot workability deteriorate to the contrary, and therefore the upper limit of the B amount is made 0.005%. Preferable upper limit of the B amount is 0.0045% or less, and more preferably 0.0040% or less.

The alloy elements contained in the case hardening steel of the present invention are as described above, and the balance consists of iron and unavoidable impurities. As the unavoidable impurities, elements brought in by situations of raw materials, materials, manufacturing facilities and the like for example can be cited.

In the case hardening steel of the present invention, it is also effective to further contain (a) Mo, (b) Cu and/or Ni, and the like as other elements according to the necessity in addition to the elements described above, and the properties of the case hardening steel is further improved according to the kind of the element contained.

[(a) Mo: 2% or Less (Excluding 0%)]

Mo is an element useful in improving the quenchability in carburizing treatment and improving the impact fatigue strength of the mechanical structural part. In order to exert such action effectively, the lower limit of the Mo amount is preferably 0.2% or more, more preferably 0.30% or more, and further more preferably 0.40% or more. However, when Mo is contained excessively, the deformation resistance in cold forging increases to deteriorate the cold workability, and therefore the upper limit of the Mo amount is preferably 2% or less. More preferable upper limit of the Mo amount is 1.5% or less, and further more preferably 1.0% or less.

[(b) Cu: 0.1% or Less (Excluding 0%) and/or Ni: 3% or Less (Excluding 0%)]

Similarly to Mo described above, Cu and Ni are elements useful in enhancing the quenchability in carburizing treatment and improving the impact fatigue strength of the mechanical structural part. Further, because Cu and Ni are elements not oxidized so easily as Fe, they also have an action of improving the corrosion resistance of the mechanical structural part. In order to exert such actions effectively, Cu is preferably contained by 0.03% or more, more preferably 0.04% or more, and further more preferably 0.05% or more. Ni is preferably contained by 0.03% or more, more preferably 0.05% or more, and further more preferably 0.08% or more. However, when Cu is contained excessively, the hot rollability deteriorates and problems such as cracking and the like are liable to occur. Therefore, preferable upper limit of the Cu amount is made 0.1% or less. More preferable Cu amount is 0.08% or less, and further more preferably 0.05% or less. Also, when Ni is contained excessively, the cost increases, and therefore, preferable upper limit of the Ni amount is made 3% or less. More preferable Ni amount is 2% or less, and further more preferably 1% or less. Either of Cu and Ni may be contained, or the both may be contained.

The composition in steel of the present invention was described above.

Next, a method for producing the case hardening steel will be described. The method for producing the case hardening steel of the present invention is characterized by including a step of preparing steel whose composition is adjusted to the range described above and executing soaking treatment (solution heat treatment) for 30 min or less at 1,100° C.-1,280° C., and a step of executing hot reworking for 120 min or less at 800-1,000° C. More specifically, the method is performed by smelting the steel, subjecting a slab casted according to an ordinary method to soaking treatment (solution heat treatment) for 30 min or less at 1,100° C.-1,280° C., thereafter hot forging, cooling to the room temperature by air cooling, and hot reworking (hot rolling for example) thereafter for 120 min or less at 800-1,000° C. Here, the former soaking treatment (solution heat treatment) is equivalent to a blooming step, and the latter hot reworking is equivalent to a steel bar rolling step.

Next, respective steps will be described in detail.

First, the steel described above is prepared, and soaking treatment (solution heat treatment) is executed for 30 min or less at 1,100° C.-1,280° C. By heating at the temperature described above and executing blooming prior to hot forging, the Ti-based precipitates formed in casting can be grown from nuclei in subsequent hot reworking with least possible solid-dissolution into a matrix, and, as a result, predetermined Ti-based precipitates can be secured.

In the present invention in particular, it is important to shorten the soaking treatment time at the temperature range described above to 30 min or less. Because the Ti-based precipitates precipitated in casting is not fully solid-dissolved into the matrix and a part thereof remains by soaking treatment of such short time, desired coarse/fine Ti-based precipitates are formed in good balance in heating at the time of steel bar rolling thereafter with the remaining Ti-based precipitates becoming forming nuclei. When the soaking treatment time exceeds 30 min, because the Ti-based precipitates precipitated in casting are fully solid-dissolved, the density of the fine Ti-based precipitates increases excessively due to heating at the time of steel bar rolling, whereas the density of the coarse Ti-based precipitates excessively drops, desired crystal grain coarsening prevention characteristics cannot be secured, the hardness drops, and desired cold forgeability cannot be secured (refer to the examples described below). Preferable soaking treatment time is 28 min or less, and more preferably 25 min or less. Also, when the soaking treatment time is too short, because a part of the Ti-based precipitates formed in casting cannot be solid-dissolved sufficiently, the fine Ti-based precipitates that can become forming nuclei of the coarse Ti-based precipitates by heating at the time of steel bar rolling are liable to remain excessively. Therefore, the soaking treatment time in the temperature range described above is preferably 10 min or more, and more preferably 15 min or more.

Also, in the present invention, from the viewpoint similar to the reason the soaking treatment time is controlled, the soaking treatment temperature is controlled to 1,100° C.-1,280° C. When the soaking treatment temperature exceeds 1,280° C., because the Ti-based precipitates precipitated in casting are fully solid-dissolved, the density of the fine Ti-based precipitates excessively increases by heating at the time of steel bar rolling whereas the density of the coarse Ti-based precipitates excessively drops, desired crystal grain coarsening prevention characteristics cannot be secured, the hardness drops, and desired cold forgeability cannot be secured (refer to the examples described below). Also, when the soaking treatment temperature is below 1,100° C., because a part of the Ti-based precipitates formed in casting cannot be solid-dissolved sufficiently, the fine Ti-based precipitates that can be the forming nuclei of the coarse Ti-based precipitates by heating at the time of steel bar rolling are liable to remain excessively. Preferable soaking treatment temperature is 1,150° C.-1,270° C., and more preferably 1,200° C.-1,260° C.

A billet obtained by thus blooming is hot-forged, is cooled to the room temperature by air cooling and the like, is thereafter reheated to be hot-worked (hot rolling such as steel bar rolling and the like for example), and thereby the case hardening steel of the present invention is obtained. In the present invention, it is important to make the temperature in reheating a temperature (800° C.-1,000° C.) comparatively lower than the soaking treatment temperature described above (1,100° C.-1,280° C.) and to execute treatment of 120 min or less, and thereby the case hardening steel whose precipitation state of the Ti-based precipitates is properly controlled is obtained.

Here, when the heating temperature at the time of hot reworking is excessively high, there is the risk that the Ti-based precipitates obtained in blooming are solid-dissolved into the matrix, the density of the coarse Ti-based precipitates drops, the density of the fine Ti-based precipitates increases, and desired density of the coarse Ti-based precipitates cannot be obtained. As a result, desired crystal grain coarsening prevention characteristics cannot be obtained, and the cold forgeability deteriorates (refer to the example described below). On the other hand, when the heating temperature at the time of hot reworking is excessively low, growth from nuclei of the Ti-based precipitates is not promoted, the coarse Ti-based precipitates are not formed, and coarsening of the crystal grain after carburization is liable to occur. Also, when the heating time at the time of hot reworking is excessively long, this may cause the Ostwald ripening and the drop of the density of the fine or coarse Ti-based precipitates that are required for preventing coarsening of the crystal grain in carburizing (refer to the example described below). Preferable condition at the time of hot reworking is; temperature: 825° C. or above and 975° C. or below, time: 60 min or less, and more preferable condition is; temperature: 850° C. or above and 950° C. or below, time: 45 min or less. Also, when the heating time at the time of hot reworking is too short, such trouble that the coarse Ti-based precipitates are not formed, coarsening of the crystal grain after carburization is liable to occur, and the like occurs, the heating temperature at the time of hot reworking is therefore preferably 10 min or more, and more preferably 15 min or more.

The case hardening steel thus obtained is formed into a predetermined part shape by cold working (cold forging for example) according to an ordinary method, is thereafter subjected to carburizing treatment according to an ordinary method, and thereby the mechanical structural part can be manufactured. The carburizing treatment condition is not particularly limited, and the treatment can be performed, for example, by being held for approximately 1-12 hours at approximately 850-950° C. under a generalized carburizing atmosphere.

In the mechanical structural part thus obtained, (A) the average grain size index of prior austenitic grain in a region from the surface to the position of 200 μm depth is No. 8-14, (B) the average grain size index of prior austenitic grain in a region from the position of 200 μm depth to the position of 500 μm depth from the surface is No. 6-12, and a coarse grain of prior austenitic grain with the grain size index of No. 5.5 or below is not contained. In the present invention, when the crystal grain size index of the mechanical structural part after carburization is measured, those satisfying the requirement described above are evaluated to be "excellent in crystal grain coarsening prevention characteristics after carburization".

The present invention is very useful in terms not only that coarsening of the crystal grains present in the outer most layer region from the surface to the position of 200 μm depth can be prevented but also that coarsening of the crystal grains present in the inner region from the position of 200 μm depth to the position of 500 μm depth from the surface can be prevented. Here, preferable average grain size index of prior austenitic grain in a region from the surface to the position of 200 μm depth is No. 8-14. Also, preferable average grain size index of prior austenitic grain in a region from the position of 200 μm depth to the position of 500 μm depth from the surface is No. 6-12, and a prior austenitic grain with the grain size index of No. 5.5 or below is not to be contained.

As a concrete form of the mechanical structural part obtained by the present invention, a gear, gear with a shaft, shaft group such as a crankshaft and the like, continuously variable transmission (CVT) pulley, constant velocity joint (CVJ), bearing and the like can be cited for example. The case hardening steel of the present invention can be suitably used as a bevel gear used for a differential unit in particular among the gears.

Below, the present invention will be described more specifically referring to examples, however, the present invention is not limited by the examples described below and can also be implemented with modifications being added within the scope adaptable to the purposes described above and below, and any of them is to be included within the technical scope of the present invention.

EXAMPLES

Steel was smelted with a smelting furnace, and billets containing the chemical composition shown in Table 1 or Table 2 below (the balance consists of iron and unavoidable impurities) were produced.

Next, the billet obtained was heated to the blooming temperature shown in Table 1 or Table 2 below, was thereafter subjected to blooming, and was then cooled to the room temperature. Then, the billet was heated to the steel bar rolling temperature shown in Table 1 or Table 2 below and was subjected to steel bar rolling, and a steel bar with 55 mm diameter was produced.

The steel bar thus obtained was measured as described below.

(1) Measurement of Density of Ti-Based Precipitates in Steel Bar

At the D/4 position (D is the diameter of the steel bar) of a transverse cross section (a plane orthogonal to the axis of the steel bar) of the steel bar, a vertical cross section (a plane parallel to the axis of the steel bar) is polished, with respect to an optional field of observation of 0.9 μm×1.3 both of (a) TEM (transmission electron microscope) observation and (b) EDX (energy dispersion type X-ray spectrometry) analysis were executed by the condition described below, the componential composition was measured, and the Ti-based precipitates were identified. The software used for the analysis of the precipitates is "Particle Analysis Ver. 30" made by Sumitomo Kinzoku Technology Kabushiki Kaisha.

Next, (c) STEM-HAADE (high-angled scattering dark field scanning-transmission electron microscope) observation was executed, the size (circle-equivalent diameter) of the Ti-based precipitates was confirmed by the STEM image, and the precipitation state (density) of the Ti-based precipitates was measured in the HAADF image. Operations similar to the above were executed for three fields of view in total, the average was calculated, and the density of the fine Ti-based precipitates having the circle-equivalent diameter of less than 20 nm and the density of the coarse Ti-based precipitates having the circle-equivalent diameter of 20 nm or more, both of the precipitates being present per 1 $\mu m^2$ of the field of view, were measured respectively.

Detailed measuring conditions are as described below.

(a) Transmission electron microscope: HF-2200 type field emission type transmission electron microscope (made by Hitachi, Ltd.)

(Acceleration voltage: 200 kV)

(Observation magnifications: 100,000 times)

(b) EDX analyzer: EMAX7000 type EDX analyzer (made by Horiba, Ltd.)

(c) STEM-HAADE observation apparatus: HF-2210 type scanning transmission image observation apparatus (made by Hitachi, Ltd.)

(Acceleration voltage: 200 kV)

(Observation magnifications: 100,000 times)

(2) Measurement of Deformation Resistance

A cylindrical specimen of 20 mm diameter×30 mm parallel to the vertical direction (plane orthogonal to the axis) with the D/4 position of the transverse cross section of the steel bar being the circle center was manufactured, the end surface constraint compression test in which compressing work was executed from a state the end surfaces of the specimen were constrained was executed, and the deformation resistance during cold forging (average deformation resistance to 55%) was measured. More specifically, the compression test described below was executed with respect to the longitudinal direction of the specimen, and the deformation resistance to 0-55% was measured based on the stress-strain curve obtained. Similar operations were executed for specimens of total three pieces, and the average value thereof was made "average deformation resistance to 55%".

(Compression Test Condition)

Compression tester: LCH1600 link type 1,600 ton press (made by Kobe Steel, Ltd.)

(Average strain rate: 8.78 $sec^{-1}$)

(Maximum compressibility: 85%)

(Compressing temperature: room temperature)

In the present example, those in which the average deformation resistance to 55% measured as described above was 600 MPa or less were deemed to be acceptable.

(3) Measurement of Vickers Hardness

The cylindrical specimen of 20 mm diameter×30 mm described in (2) mentioned above (one before the compression test was executed) was prepared, a plane orthogonal to the longitudinal direction was cut out, and the D/4 position (D shows the radius) in the cross section was measured. The hardness inside the prior austenitic grain was measured using a micro Vickers hardness tester with 10 g load. Five locations were measured, and the average value was calculated.

Next, with respect to the specimen for the compression test used in the measurement of above (2), carburizing treatment of the condition shown in FIG. 1 was executed. More specifically, as shown in FIG. 1, the specimen was heated to 950° C., was held for 350 min in the condition of 0.8% of the carbon potential (CP) at the temperature, was then cooled to 860° C., was held for 70 min in the condition of 0.8% of the carbon potential (CP) at the temperature, was quenched using an oil bath of 70° C., and was cooled to the room temperature.

In the present example, those in which the Vickers hardness measured as described above was 130 HV or below were deemed to be acceptable.

With respect to the specimen subjected to the carburizing treatment, (4) the crystal grain size was examined.

(4) Measurement of Crystal Grain Size

The cross section parallel to the compression direction of the specimen was cut out and was etched by nital liquid, thereafter the surface layer section of 16 mm in the direction from the center to the periphery (the region from the surface to the position of 200 μm depth) and the inner region (the region from the position of 200 μm depth to the position of 500 μm depth from the surface) were observed under an optical microscope of 400 magnifications, and the grain size index of the prior austenite (prior y) was determined in accordance with JIS G 0551.

In the present invention, those in which (A) the average grain size index of prior austenitic grain in the surface layer section was No. 8-14, (B) the average grain size index of prior austenitic grain in the inside was No. 6-12, and a coarse grain of prior austenitic grain with the grain size index of No. 5.5 or below was not contained were evaluated to be acceptable (excellent in the crystal grain coarsening prevention characteristics after carburization).

For reference purpose, a column of "coarse grain" was arranged in Table 3 and Table 4, "present" was described for those the coarse grains (those with the crystal grain size index of No. 5.5 or below) were seen in the field of view, and "none" was described for those the coarse grains were not seen. Also, only for those the coarse grains were seen, the maximum crystal grain size index out of the crystal grains present in the field of view was described.

In the present example, those satisfying both of the average deformation resistance to 55% in above (2) and the Vickers hardness of above (3) were evaluated to be acceptable (excellent in the cold forgeability).

These results are shown in Table 3 and Table 4.

TABLE 1

| Test | Chemical composition (mass %) | | | | | | | | | | | | | Blooming | | Steel bar rolling | |
|---|---|---|---|---|---|---|---|---|---|---|---|---|---|---|---|---|---|
| | Indispensable element | | | | | | | | | | Selective element | | | Temperature | Time | Temperature | Time |
| No. | C | Si | Mn | P | S | Cr | Al | Ti | N | B | Cu | Ni | Mo | (° C.) | (min) | (° C.) | (min) |
| 1 | 0.09 | 0.04 | 0.33 | 0.009 | 0.008 | 1.73 | 0.029 | 0.048 | 0.0035 | 0.0020 | | | | 1250 | 25 | 870 | 60 |
| 2 | 0.17 | 0.06 | 0.44 | 0.009 | 0.009 | 1.38 | 0.048 | 0.045 | 0.0056 | 0.0038 | | | | 1250 | 25 | 900 | 60 |
| 3 | 0.14 | 0.09 | 0.32 | 0.010 | 0.006 | 1.44 | 0.049 | 0.079 | 0.0039 | 0.0034 | | | | 1250 | 25 | 850 | 60 |
| 4 | 0.19 | 0.09 | 0.48 | 0.013 | 0.010 | 1.41 | 0.030 | 0.015 | 0.0032 | 0.0023 | | | | 1250 | 25 | 1000 | 60 |
| 5 | 0.16 | 0.03 | 0.38 | 0.013 | 0.009 | 1.98 | 0.044 | 0.058 | 0.0038 | 0.0025 | | | | 1250 | 25 | 900 | 60 |
| 6 | 0.06 | 0.04 | 0.58 | 0.012 | 0.006 | 1.49 | 0.040 | 0.052 | 0.0029 | 0.0045 | | | | 1250 | 25 | 850 | 60 |
| 7 | 0.19 | 0.09 | 0.59 | 0.009 | 0.002 | 1.66 | 0.030 | 0.019 | 0.0041 | 0.0026 | | | | 1250 | 25 | 1000 | 60 |
| 8 | 0.18 | 0.07 | 0.53 | 0.005 | 0.009 | 1.53 | 0.042 | 0.045 | 0.0032 | 0.0046 | | | | 1250 | 25 | 900 | 60 |
| 9 | 0.07 | 0.04 | 0.45 | 0.008 | 0.005 | 1.55 | 0.024 | 0.024 | 0.0076 | 0.0042 | | | | 1250 | 25 | 900 | 60 |
| 10 | 0.09 | 0.06 | 0.33 | 0.014 | 0.004 | 1.37 | 0.021 | 0.070 | 0.0045 | 0.0046 | | | | 1250 | 25 | 850 | 60 |
| 11 | 0.08 | 0.10 | 0.31 | 0.017 | 0.010 | 1.46 | 0.012 | 0.065 | 0.0035 | 0.0037 | | | | 1250 | 25 | 870 | 60 |
| 12 | 0.11 | 0.08 | 0.49 | 0.008 | 0.007 | 1.56 | 0.019 | 0.041 | 0.0037 | 0.0013 | | | | 1250 | 25 | 900 | 60 |
| 13 | 0.11 | 0.10 | 0.59 | 0.015 | 0.004 | 1.88 | 0.036 | 0.053 | 0.0074 | 0.0026 | | | | 1250 | 25 | 900 | 60 |
| 14 | 0.10 | 0.05 | 0.31 | 0.015 | 0.006 | 1.58 | 0.012 | 0.062 | 0.0075 | 0.0013 | | | | 1250 | 25 | 850 | 60 |
| 15 | 0.14 | 0.03 | 0.34 | 0.015 | 0.007 | 1.85 | 0.044 | 0.059 | 0.0033 | 0.0019 | | | 0.83 | 1250 | 25 | 900 | 60 |
| 16 | 0.06 | 0.10 | 0.45 | 0.019 | 0.003 | 1.78 | 0.021 | 0.050 | 0.0079 | 0.0023 | | | 0.38 | 1250 | 25 | 900 | 60 |
| 17 | 0.14 | 0.03 | 0.56 | 0.012 | 0.005 | 1.79 | 0.038 | 0.052 | 0.0074 | 0.0019 | | | | 1250 | 25 | 870 | 60 |
| 18 | 0.19 | 0.03 | 0.45 | 0.018 | 0.002 | 1.45 | 0.037 | 0.085 | 0.0072 | 0.0046 | | | | 1250 | 25 | 850 | 60 |
| 19 | 0.12 | 0.02 | 0.44 | 0.016 | 0.006 | 1.33 | 0.035 | 0.075 | 0.0039 | 0.0034 | | | | 1250 | 25 | 850 | 60 |
| 20 | 0.18 | 0.08 | 0.37 | 0.014 | 0.009 | 1.80 | 0.037 | 0.078 | 0.0058 | 0.0036 | | | | 1250 | 25 | 870 | 60 |

TABLE 1-continued

| Test No. | Chemical composition (mass %) Indispensable element C | Si | Mn | P | S | Cr | Al | Ti | N | B | Selective element Cu | Ni | Mo | Blooming Temperature (° C.) | Time (min) | Steel bar rolling Temperature (° C.) | Time (min) |
|---|---|---|---|---|---|---|---|---|---|---|---|---|---|---|---|---|---|
| 21 | 0.12 | 0.03 | 0.48 | 0.008 | 0.005 | 1.61 | 0.012 | 0.061 | 0.0070 | 0.0013 | | | | 1250 | 25 | 900 | 60 |
| 22 | 0.17 | 0.02 | 0.50 | 0.014 | 0.004 | 1.23 | 0.025 | 0.068 | 0.0044 | 0.0016 | | | | 1250 | 25 | 870 | 60 |
| 23 | 0.12 | 0.10 | 0.38 | 0.006 | 0.009 | 1.94 | 0.033 | 0.052 | 0.0045 | 0.0018 | | | | 1250 | 25 | 900 | 60 |
| 24 | 0.08 | 0.01 | 0.39 | 0.019 | 0.011 | 1.83 | 0.028 | 0.027 | 0.0078 | 0.0035 | 0.05 | | 0.45 | 1250 | 25 | 900 | 60 |
| 25 | 0.10 | 0.10 | 0.30 | 0.013 | 0.005 | 1.75 | 0.011 | 0.066 | 0.0061 | 0.0012 | | | | 1250 | 25 | 870 | 60 |
| 26 | 0.12 | 0.08 | 0.38 | 0.019 | 0.005 | 1.49 | 0.023 | 0.024 | 0.0079 | 0.0029 | | 0.12 | | 1250 | 25 | 950 | 60 |
| 27 | 0.09 | 0.02 | 0.31 | 0.010 | 0.010 | 1.31 | 0.049 | 0.065 | 0.0042 | 0.0018 | | | | 1250 | 25 | 850 | 60 |
| 28 | 0.12 | 0.03 | 0.40 | 0.012 | 0.004 | 1.54 | 0.022 | 0.011 | 0.0048 | 0.0041 | 0.07 | 0.11 | | 1250 | 25 | 1000 | 60 |
| 29 | 0.11 | 0.03 | 0.57 | 0.005 | 0.006 | 1.54 | 0.032 | 0.057 | 0.0034 | 0.0020 | | | | 1250 | 25 | 900 | 60 |
| 30 | 0.11 | 0.09 | 0.45 | 0.019 | 0.006 | 1.99 | 0.022 | 0.038 | 0.0074 | 0.0037 | | | | 1250 | 25 | 900 | 60 |
| 31 | 0.18 | 0.06 | 0.31 | 0.013 | 0.009 | 1.73 | 0.041 | 0.074 | 0.0041 | 0.0012 | | | | 1250 | 25 | 900 | 60 |
| 32 | 0.06 | 0.05 | 0.53 | 0.011 | 0.005 | 1.53 | 0.010 | 0.058 | 0.0044 | 0.0047 | | | 0.82 | 1250 | 25 | 850 | 60 |

TABLE 2

| Test No. | Chemical composition (mass %) Indispensable element C | Si | Mn | P | S | Cr | Al | Ti | N | B | Selective element Cu | Ni | Mo | Blooming Temperature (° C.) | Time (min) | Steel bar rolling Temperature (° C.) | Time (min) |
|---|---|---|---|---|---|---|---|---|---|---|---|---|---|---|---|---|---|
| 33 | 0.19 | 0.03 | 0.51 | 0.007 | 0.005 | 1.40 | 0.010 | 0.066 | 0.0060 | 0.0030 | | | | 1250 | 25 | 900 | 60 |
| 34 | 0.16 | 0.08 | 0.33 | 0.017 | 0.008 | 1.48 | 0.010 | 0.046 | 0.0057 | 0.0044 | | | | 1250 | 25 | 900 | 60 |
| 35 | 0.19 | 0.05 | 0.39 | 0.006 | 0.009 | 1.73 | 0.047 | 0.044 | 0.0063 | 0.0038 | | | | 1250 | 25 | 900 | 60 |
| 36 | 0.06 | 0.02 | 0.32 | 0.019 | 0.004 | 1.92 | 0.018 | 0.065 | 0.0032 | 0.0013 | 0.08 | | | 1250 | 25 | 850 | 60 |
| 37 | 0.09 | 0.09 | 0.30 | 0.017 | 0.010 | 1.40 | 0.016 | 0.032 | 0.0047 | 0.0012 | | | | 1250 | 25 | 900 | 60 |
| 38 | 0.08 | 0.03 | 0.32 | 0.009 | 0.010 | 1.94 | 0.021 | 0.055 | 0.0057 | 0.0040 | | | | 1250 | 25 | 900 | 60 |
| 39 | 0.06 | 0.09 | 0.49 | 0.005 | 0.011 | 1.73 | 0.025 | 0.028 | 0.0052 | 0.0022 | | | | 1250 | 25 | 900 | 60 |
| 40 | 0.08 | 0.06 | 0.59 | 0.009 | 0.009 | 1.93 | 0.016 | 0.029 | 0.0076 | 0.0026 | | | | 1250 | 25 | 900 | 60 |
| 41 | 0.20 | 0.08 | 0.31 | 0.013 | 0.005 | 1.81 | 0.022 | 0.060 | 0.0025 | 0.0011 | | | | 1250 | 25 | 900 | 60 |
| 42 | 0.10 | 0.01 | 0.45 | 0.019 | 0.006 | 1.80 | 0.045 | 0.022 | 0.0046 | 0.0014 | | | | 1250 | 25 | 900 | 60 |
| 43 | 0.16 | 0.04 | 0.38 | 0.015 | 0.012 | 1.84 | 0.029 | 0.042 | 0.0043 | 0.0015 | | | | 1250 | 25 | 900 | 60 |
| 44 | 0.13 | 0.02 | 0.36 | 0.013 | 0.004 | 1.69 | 0.037 | 0.055 | 0.0064 | 0.0047 | 0.06 | 0.09 | 0.41 | 1250 | 25 | 950 | 60 |
| 45 | 0.18 | 0.06 | 0.48 | 0.013 | 0.011 | 1.72 | 0.017 | 0.050 | 0.0071 | 0.0036 | | | | 1250 | 25 | 900 | 60 |
| 46 | 0.19 | 0.05 | 0.34 | 0.006 | 0.007 | 1.96 | 0.020 | 0.085 | 0.0033 | 0.0027 | | | | 1250 | 25 | 850 | 60 |
| 47 | 0.05 | 0.06 | 0.49 | 0.006 | 0.010 | 1.30 | 0.022 | 0.030 | 0.0046 | 0.0038 | | | | 1250 | 25 | 900 | 60 |
| 48 | 0.10 | 0.02 | 0.51 | 0.015 | 0.010 | 1.56 | 0.017 | 0.042 | 0.0034 | 0.0013 | | | | 1250 | 25 | 900 | 60 |
| 49 | 0.06 | 0.09 | 0.32 | 0.007 | 0.005 | 1.23 | 0.021 | 0.064 | 0.0051 | 0.0046 | | | | 1250 | 25 | 850 | 60 |
| 50 | 0.16 | 0.10 | 0.39 | 0.019 | 0.002 | 1.27 | 0.031 | 0.039 | 0.0065 | 0.0024 | | | | 1250 | 25 | 900 | 60 |
| 51 | 0.20 | 0.08 | 0.50 | 0.010 | 0.010 | 1.00 | 0.030 | 0.040 | 0.0080 | 0.0020 | | | | 1250 | 300 | 900 | 300 |
| 52 | 0.23 | 0.08 | 0.32 | 0.013 | 0.006 | 1.69 | 0.036 | 0.045 | 0.0058 | 0.0047 | | | | 1250 | 25 | 900 | 60 |
| 53 | 0.03 | 0.15 | 0.38 | 0.010 | 0.008 | 1.73 | 0.045 | 0.042 | 0.0051 | 0.0040 | | | | 1250 | 25 | 900 | 60 |
| 54 | 0.09 | 0.50 | 0.38 | 0.016 | 0.008 | 1.72 | 0.028 | 0.048 | 0.0052 | 0.0047 | | | | 1250 | 25 | 900 | 60 |
| 55 | 0.12 | 0.04 | 0.82 | 0.010 | 0.007 | 1.52 | 0.035 | 0.044 | 0.0063 | 0.0047 | | | | 1250 | 25 | 900 | 60 |
| 56 | 0.13 | 0.10 | 0.12 | 0.011 | 0.006 | 1.64 | 0.037 | 0.049 | 0.0072 | 0.0047 | | | | 1250 | 25 | 900 | 60 |
| 57 | 0.10 | 0.12 | 0.38 | 0.009 | 0.009 | 2.15 | 0.033 | 0.043 | 0.0067 | 0.0047 | | | | 1250 | 25 | 900 | 60 |
| 58 | 0.16 | 0.03 | 0.45 | 0.014 | 0.008 | 1.52 | 0.162 | 0.038 | 0.0064 | 0.0047 | | | | 1250 | 25 | 900 | 60 |
| 59 | 0.11 | 0.05 | 0.55 | 0.011 | 0.008 | 1.60 | 0.032 | 0.105 | 0.0052 | 0.0047 | | | | 1250 | 25 | 900 | 60 |
| 60 | 0.16 | 0.02 | 0.52 | 0.008 | 0.010 | 1.58 | 0.038 | 0.008 | 0.0058 | 0.0047 | | | | 1250 | 25 | 900 | 60 |
| 61 | 0.12 | 0.09 | 0.43 | 0.007 | 0.012 | 1.71 | 0.034 | 0.038 | 0.0121 | 0.0047 | | | | 1250 | 25 | 900 | 60 |
| 62 | 0.13 | 0.06 | 0.41 | 0.015 | 0.008 | 1.68 | 0.037 | 0.046 | 0.0064 | 0.0047 | | | | 1250 | 25 | 1050 | 60 |
| 63 | 0.14 | 0.02 | 0.48 | 0.006 | 0.005 | 1.52 | 0.012 | 0.042 | 0.0058 | 0.0013 | | | | 1250 | 300 | 900 | 60 |
| 64 | 0.13 | 0.03 | 0.48 | 0.008 | 0.005 | 1.63 | 0.011 | 0.028 | 0.0071 | 0.0012 | | | | 1250 | 25 | 900 | 300 |
| 65 | 0.13 | 0.03 | 0.54 | 0.005 | 0.005 | 0.95 | 0.032 | 0.057 | 0.0032 | 0.0020 | | | | 1250 | 25 | 900 | 60 |

TABLE 3

| Test No. | Ti-based precipitates density (pieces/μm²) Less than 20 nm | 20 nm or more | Evaluation | Cold forgeability Hardness (HV) | Average deformation resistance to 55% (MPa) | Evaluation | Crystal grain size 0-200 μm position Average grain size | Coarse grain | Maximum grain size | 200-500 μm Average grain size | Coarse grain | Maximum grain size | Evaluation | Comprehensive evaluation |
|---|---|---|---|---|---|---|---|---|---|---|---|---|---|---|
| 1 | 26.0 | 8.9 | ○ | 123 | 561 | ○ | 11.0 | None | — | 9.0 | None | — | ○ | ○ |
| 2 | 53.1 | 5.6 | ○ | 127 | 582 | ○ | 13.5 | None | — | 8.0 | None | — | ○ | ○ |

TABLE 3-continued

| | Ti-based precipitates density (pieces/μm²) | | | Cold forgeability | | | Crystal grain size | | | | | | | |
|---|---|---|---|---|---|---|---|---|---|---|---|---|---|---|
| | | | | | Average deformation | | 0-200 μm position | | | 200-500 μm | | | | |
| Test No. | Less than 20 nm | 20 nm or more | Evaluation | Hardness (HV) | resistance to 55% (MPa) | Evaluation | Average grain size | Coarse grain | Maximum grain size | Average grain size | Coarse grain | Maximum grain size | Evaluation | Comprehensive evaluation |
| 3 | 98.5 | 8.7 | ○ | 116 | 589 | ○ | 12.5 | None | — | 8.5 | None | — | ○ | ○ |
| 4 | 11.8 | 3.8 | ○ | 100 | 488 | ○ | 9.0 | None | — | 7.0 | None | — | ○ | ○ |
| 5 | 69.1 | 5.9 | ○ | 106 | 561 | ○ | 13.0 | None | — | 7.5 | None | — | ○ | ○ |
| 6 | 67.4 | 5.1 | ○ | 109 | 551 | ○ | 12.0 | None | — | 8.0 | None | — | ○ | ○ |
| 7 | 20.6 | 5.2 | ○ | 112 | 504 | ○ | 10.0 | None | — | 7.5 | None | — | ○ | ○ |
| 8 | 33.4 | 6.8 | ○ | 106 | 525 | ○ | 10.5 | None | — | 8.0 | None | — | ○ | ○ |
| 9 | 26.1 | 3.8 | ○ | 106 | 502 | ○ | 10.0 | None | — | 8.0 | None | — | ○ | ○ |
| 10 | 96.4 | 3.9 | ○ | 111 | 580 | ○ | 12.5 | None | — | 7.5 | None | — | ○ | ○ |
| 11 | 98.5 | 7.3 | ○ | 114 | 580 | ○ | 11.5 | None | — | 8.5 | None | — | ○ | ○ |
| 12 | 49.4 | 5.2 | ○ | 96 | 535 | ○ | 10.5 | None | — | 8.0 | None | — | ○ | ○ |
| 13 | 75.8 | 6.2 | ○ | 111 | 568 | ○ | 13.0 | None | — | 7.5 | None | — | ○ | ○ |
| 14 | 75.2 | 7.6 | ○ | 104 | 566 | ○ | 11.0 | None | — | 9.5 | None | — | ○ | ○ |
| 15 | 78.4 | 8.8 | ○ | 109 | 580 | ○ | 12.5 | None | — | 8.5 | None | — | ○ | ○ |
| 16 | 86.9 | 5.4 | ○ | 111 | 576 | ○ | 13.0 | None | — | 8.5 | None | — | ○ | ○ |
| 17 | 48.6 | 8.4 | ○ | 106 | 544 | ○ | 10.5 | None | — | 9.0 | None | — | ○ | ○ |
| 18 | 94.0 | 8.7 | ○ | 115 | 587 | ○ | 10.5 | None | — | 8.5 | None | — | ○ | ○ |
| 19 | 82.1 | 5.2 | ○ | 115 | 572 | ○ | 11.0 | None | — | 8.5 | None | — | ○ | ○ |
| 20 | 91.7 | 9.4 | ○ | 115 | 582 | ○ | 11.0 | None | — | 8.5 | None | — | ○ | ○ |
| 21 | 89.9 | 7.2 | ○ | 113 | 586 | ○ | 12.5 | None | — | 9.0 | None | — | ○ | ○ |
| 22 | 73.2 | 9.5 | ○ | 117 | 566 | ○ | 13.0 | None | — | 9.0 | None | — | ○ | ○ |
| 23 | 70.1 | 4.6 | ○ | 113 | 559 | ○ | 11.5 | None | — | 7.0 | None | — | ○ | ○ |
| 24 | 29.2 | 6.8 | ○ | 95 | 508 | ○ | 10.5 | None | — | 8.0 | None | — | ○ | ○ |
| 25 | 93.6 | 5.1 | ○ | 112 | 583 | ○ | 12.5 | None | — | 7.5 | None | — | ○ | ○ |
| 26 | 32.4 | 6.1 | ○ | 98 | 526 | ○ | 11.0 | None | — | 8.0 | None | — | ○ | ○ |
| 27 | 85.4 | 7.9 | ○ | 109 | 572 | ○ | 11.5 | None | — | 9.5 | None | — | ○ | ○ |
| 28 | 27.7 | 6.2 | ○ | 93 | 515 | ○ | 11.0 | None | — | 8.0 | None | — | ○ | ○ |
| 29 | 84.6 | 9.6 | ○ | 113 | 576 | ○ | 13.0 | None | — | 9.5 | None | — | ○ | ○ |
| 30 | 42.8 | 4.0 | ○ | 100 | 525 | ○ | 10.5 | None | — | 7.0 | None | — | ○ | ○ |
| 31 | 97.3 | 7.4 | ○ | 119 | 596 | ○ | 11.5 | None | — | 9.0 | None | — | ○ | ○ |
| 32 | 80.6 | 6.3 | ○ | 108 | 559 | ○ | 12.5 | None | — | 8.5 | None | — | ○ | ○ |

TABLE 4

| | Ti-based precipitates density (pieces/μm²) | | | Cold forgeability | | | Crystal grain size | | | | | | | |
|---|---|---|---|---|---|---|---|---|---|---|---|---|---|---|
| | | | | | Average deformation | | 0-200 μm position | | | 200-500 μm | | | | |
| Test No. | Less than 20 nm | 20 nm or more | Evaluation | Hardness (HV) | resistance to 55% (MPa) | Evaluation | Average grain size | Coarse grain | Maximum grain size | Average grain size | Coarse grain | Maximum grain size | Evaluation | Comprehensive evaluation |
| 33 | 76.1 | 6.1 | ○ | 110 | 570 | ○ | 13.0 | None | — | 8.5 | None | — | ○ | ○ |
| 34 | 42.7 | 6.6 | ○ | 110 | 534 | ○ | 12.0 | None | — | 8.0 | None | — | ○ | ○ |
| 35 | 27.7 | 7.6 | ○ | 109 | 516 | ○ | 11.0 | None | — | 8.5 | None | — | ○ | ○ |
| 36 | 96.0 | 3.3 | ○ | 114 | 571 | ○ | 11.5 | None | — | 7.5 | None | — | ○ | ○ |
| 37 | 36.7 | 8.0 | ○ | 98 | 520 | ○ | 11.0 | None | — | 9.0 | None | — | ○ | ○ |
| 38 | 90.8 | 6.5 | ○ | 110 | 577 | ○ | 12.5 | None | — | 8.5 | None | — | ○ | ○ |
| 39 | 38.5 | 5.4 | ○ | 98 | 522 | ○ | 11.0 | None | — | 8.5 | None | — | ○ | ○ |
| 40 | 33.6 | 6.0 | ○ | 101 | 520 | ○ | 11.0 | None | — | 8.0 | None | — | ○ | ○ |
| 41 | 59.4 | 8.2 | ○ | 112 | 555 | ○ | 12.0 | None | — | 9.0 | None | — | ○ | ○ |
| 42 | 11.1 | 5.2 | ○ | 98 | 474 | ○ | 8.5 | None | — | 8.0 | None | — | ○ | ○ |
| 43 | 33.9 | 8.1 | ○ | 102 | 524 | ○ | 11.0 | None | — | 9.0 | None | — | ○ | ○ |
| 44 | 68.0 | 5.8 | ○ | 106 | 569 | ○ | 13.0 | None | — | 7.5 | None | — | ○ | ○ |
| 45 | 44.4 | 5.8 | ○ | 100 | 537 | ○ | 12.0 | None | — | 8.0 | None | — | ○ | ○ |
| 46 | 94.0 | 8.6 | ○ | 112 | 589 | ○ | 13.0 | None | — | 9.0 | None | — | ○ | ○ |
| 47 | 46.4 | 5.2 | ○ | 102 | 527 | ○ | 12.0 | None | — | 8.0 | None | — | ○ | ○ |
| 48 | 55.1 | 5.7 | ○ | 106 | 548 | ○ | 11.5 | None | — | 8.5 | None | — | ○ | ○ |
| 49 | 93.8 | 4.9 | ○ | 119 | 577 | ○ | 13.0 | None | — | 8.0 | None | — | ○ | ○ |
| 50 | 27.3 | 8.5 | ○ | 99 | 514 | ○ | 11.0 | None | — | 9.0 | None | — | ○ | ○ |
| 51 | 139.0 | 1.2 | X | 132 | 635 | X | 11.0 | None | — | 8.0 | None | — | ○ | X |
| 52 | 120.2 | 1.2 | X | 138 | 613 | X | 13.0 | None | — | 8.5 | None | — | ○ | X |
| 53 | 18.0 | 0.2 | X | 92 | 476 | ○ | 9.5 | None | — | 7.0 | Present | 3.0 | X | X |
| 54 | 71.9 | 0.0 | X | 134 | 554 | X | 13.0 | None | — | 8.0 | Present | 4.0 | X | X |
| 55 | 52.5 | 0.6 | X | 134 | 610 | X | 12.0 | None | — | 7.0 | Present | 3.0 | X | X |

TABLE 4-continued

| | Ti-based precipitates density (pieces/μm²) | | | Cold forgeability | | | Crystal grain size | | | | | | | |
|---|---|---|---|---|---|---|---|---|---|---|---|---|---|---|
| | | | | | Average deformation | | 0-200 μm position | | | 200-500 μm | | | | |
| Test No. | Less than 20 nm | 20 nm or more | Evaluation | Hardness (HV) | resistance to 55% (MPa) | Evaluation | Average grain size | Coarse grain | Maximum grain size | Average grain size | Coarse grain | Maximum grain size | Evaluation | Comprehensive evaluation |
| 56 | 59.9 | 0.4 | X | 118 | 550 | ○ | 12.0 | None | — | 7.0 | Present | 4.0 | X | X |
| 57 | 57.3 | 5.2 | ○ | 136 | 568 | X | 12.0 | None | — | 8.0 | None | — | ○ | X |
| 58 | 25.1 | 5.2 | ○ | 138 | 580 | X | 10.0 | None | — | 8.0 | None | — | ○ | X |
| 59 | 190.3 | 5.2 | X | 142 | 659 | X | 11.0 | None | — | 7.0 | None | — | ○ | X |
| 60 | 8.2 | 0.0 | X | 98 | 462 | ○ | 6.5 | None | — | 8.0 | Present | 4.0 | X | X |
| 61 | 2.8 | 4.1 | X | 138 | 620 | X | 6.5 | None | — | 8.0 | Present | 5.0 | X | X |
| 62 | 125.2 | 0.0 | X | 135 | 627 | X | 12.0 | None | — | 7.0 | Present | 4.0 | X | X |
| 63 | 152.1 | 0.0 | X | 148 | 635 | X | 11.5 | None | — | 7.0 | Present | 4.0 | X | X |
| 64 | 3.8 | 1.1 | X | 121 | 562 | ○ | 7.0 | None | — | 7.0 | Present | 3.0 | X | X |

From Table 3 and Table 4, following study is possible. All of Nos. 1-50 are examples satisfying the requirements stipulated in the present invention, and it is known that they are excellent in the crystal grain coarsening prevention characteristics in carburizing because the density of the fine Ti-based precipitates and the density of the coarse Ti-based precipitates are properly controlled respectively and are highly excellent in the cold forgeability also because both of the Vickers hardness and the deformation resistance are low.

On the other hand, Nos. 51-65 are examples not satisfying any of the requirements stipulated in the present invention.

No. 51 is an example in which the Cr amount is not sufficient and both of the blooming time and the steel bar rolling time are excessively long, the density of the fine Ti-based precipitates became high and the density of the coarse Ti-based precipitates became low. As a result, both of the Vickers hardness and the deformation resistance increased and the cold forgeability deteriorated.

No. 52 is an example in which there is a large amount of C, the density of the fine Ti-based precipitates became high, and the density of the coarse Ti-based precipitates became low. As a result, both of the Vickers hardness and the deformation resistance increased, and the cold forgeability deteriorated.

No. 53 is an example in which the C amount is not sufficient, and the density of the coarse Ti-based precipitates became low. As a result, coarse grains were formed inside the steel (carburized material), and desired crystal grain coarsening prevention characteristics could not be secured.

No. 54 is an example in which there is a large amount of Si, and the coarse Ti-based precipitates were not formed at all. As a result, the hardness increased, and the cold forgeability deteriorated.

No. 55 is an example in which there is a large amount of Mn, and the density of the coarse Ti-based precipitates became low. As a result, both of the Vickers hardness and the deformation resistance increased, and the cold forgeability deteriorated.

No. 56 is an example in which the Mn amount is not sufficient, and the density of the coarse Ti-based precipitates became low. As a result, both of the Vickers hardness and the deformation resistance increased, and the cold forgeability deteriorated. Also, coarse grains were formed inside the steel (carburized material), and desired crystal grain coarsening prevention characteristics could not be secured.

No. 57 is an example in which there is a large amount of Cr, the hardness increased, and the cold forgeability deteriorated.

No. 58 is an example in which there is a large amount of Al, the hardness increased, and the cold forgeability deteriorated.

No. 59 is an example in which there is a large amount of Ti, and the density of the fine Ti-based precipitates became high. As a result, both of the Vickers hardness and the deformation resistance increased, and the cold forgeability deteriorated.

No. 60 is an example in which the Ti amount is not sufficient, the density of the fine Ti-based precipitates was low, and the coarse Ti-based precipitates were not formed at all. As a result, coarse grains were formed inside the steel (carburized material), and desired crystal grain coarsening prevention characteristics could not be secured.

No. 61 is an example in which the N amount is not sufficient, and the density of the fine Ti-based precipitates became low. As a result, coarse grains were formed inside the steel (carburized material), and desired crystal grain coarsening prevention characteristics could not be secured. Also, because the N amount is not sufficient, the Vickers hardness increased, and the cold forgeability deteriorated.

No. 62 is an example in which the steel bar rolling temperature is high, the density of the fine Ti-based precipitates was high, and the coarse Ti-based precipitates were not formed at all. As a result, both of the Vickers hardness and the deformation resistance increased, and the cold forgeability deteriorated. Also, coarse grains were formed inside the steel (carburized material), and desired crystal grain coarsening prevention characteristics could not be secured.

No. 63 is an example in which the blooming time is long, the density of the fine Ti-based precipitates was high, and the coarse Ti-based precipitates were not formed at all. As a result, both of the Vickers hardness and the deformation resistance increased, and the cold forgeability deteriorated. Also, coarse grains were formed inside the steel (carburized material), and desired crystal grain coarsening prevention characteristics could not be secured.

No. 64 is an example in which the steel bar rolling time is long, the density of the fine Ti-based precipitates became low, and the density of the coarse Ti-based precipitates also became low. As a result, coarse grains were formed inside the steel (carburized material), and desired crystal grain coarsening prevention characteristics could not be secured.

No. 65 is an example in which the Cr amount is less, and the density of the coarse Ti-based precipitates became low. As a result, coarse grains were formed inside the steel (carburized material), and desired crystal grain coarsening prevention characteristics could not be secured.

The invention claimed is:

1. A steel comprising, in mass %:

C: 0.05-0.20%;

Si: 0.01-0.1%;

Mn: 0.3-0.6%;

P: 0.03% or less, excluding 0%;

S: 0.001-0.02%;

Cr: 1.2-2.0%;

Al: 0.01-0.1%;

Ti: 0.010-0.10%;

N: 0.010% or less, excluding 0%; and

B: 0.0005-0.005%, with a balance comprising iron and unavoidable impurities, wherein a density of Ti-based precipitates having a circle-equivalent diameter of less than 20 nm is 10-100 pieces/$\mu m^2$, a density of Ti-based precipitates having a circle-equivalent diameter of 20 nm or more is 1.5-10 pieces/$\mu m^2$, and a Vickers hardness is 130 HV or less.

2. The steel according to claim 1, further comprising Mo: 2% or less, excluding 0%.

3. The steel according to claim 1, further comprising:

Cu: 0.1% or less, excluding 0%;

Ni: 3% or less, excluding 0%, or both.

4. A method for producing a steel, comprising:

preparing the steel according to claim 1;

soaking for 30 min or less at a temperature of from 1,100° C. to 1,280° C.; and hot reworking for 120 min or less at a temperature of from 800 to 1,000° C.

5. A mechanical structural part obtained by cold working the steel according to claim 1, and thereafter carburizing the steel, wherein an average grain size index of prior austenitic grain in a region from a surface to a position of 200 μm depth is No. 8-14;

an average grain size index of prior austenitic grain in a region from the position of 200 μm depth to a position of 500 μm depth from the surface is No. 6-12; and a coarse grain of prior austenitic grain with a grain size index of No. 5.5 or below is not contained.

* * * * *